United States Patent [19]

Yasuhara

[11] 4,328,777

[45] May 11, 1982

[54] DISTRIBUTOR-TYPE FUEL INJECTION PUMP GOVERNOR

[75] Inventor: Seishi Yasuhara, Yokosuka, Japan

[73] Assignee: Nissan Motor Co., Ltd., Yokohama, Japan

[21] Appl. No.: 138,489

[22] Filed: Apr. 9, 1980

[30] Foreign Application Priority Data

Apr. 12, 1979 [JP] Japan ..... 54-47529[U]

[51] Int. Cl.[3] ..... F02D 1/04; F02B 1/10; F02D 31/00

[52] U.S. Cl. ..... 123/364; 123/365; 123/370; 123/502; 123/371

[58] Field of Search ..... 123/364, 365, 370, 371, 123/502

[56] References Cited

U.S. PATENT DOCUMENTS 4,168,690 9/1979 Hofer ..... 123/502
4,271,806 6/1981 Kaibara et al. ..... 123/502

FOREIGN PATENT DOCUMENTS 2812176 9/1979 Fed. Rep. of Germany ..... 123/502
3019094 11/1980 Fed. Rep. of Germany ..... 123/370

*Primary Examiner*—Wendell E. Burns
*Attorney, Agent, or Firm*—Thompson, Birch, Gauthier & Samuels

[57] ABSTRACT

A governor sleeve is axially displaceable on a stationary governor shaft and has an inner space which is adjoined by the governor shaft and communicated with the inner chamber of a pump housing charged with fuel. The inner space varies in volume drawing thereinto and discharging therefrom fuel in response to axial displacement of the governor sleeve. There is provided valve and channel means which establishes restricted communication between the inner space and the inner chamber upon displacement of the governor sleeve in the direction to produce contraction of the inner space and substantially unrestricted communication between same upon displacement of the governor sleeve in the opposite direction to produce expansion of the inner chamber in order to prevent an acceleration jerk and smoky exhaust.

7 Claims, 5 Drawing Figures

DISTRIBUTOR-TYPE FUEL INJECTION PUMP GOVERNOR

BACKGROUND OF THE INVENTION

This invention relates in general to distributor-type fuel injection pumps for compression ignition internal combustion engines or Diesel engines and more particularly to governors of such fuel injection pumps.

In FIG. 1, there is shown a prior art distributor-type fuel injection pump for a compression ignition multicylinder internal combustion engine.

The prior art distributor-type fuel injection pump comprises a pump housing 1 having an inner chamber 1*a* which is charged with fuel by a fuel supply pump (not shown) through a pressure regulating valve (also not shown). To the pump housing 1 there is fixedly attached a plunger barrel 2 in which is mounted a distributor plunger 3. The distributor plunger 3 is powered by engine-driven power transmitting means (not shown) and reciprocates while rotating to effect pumping and distributing actions.

During the suction stroke or leftward stroke of the distributor plunger 3, fuel is drawn from the inner chamber 1*a* through an inlet channel 4 and longitudinal grooves 5 provided in the outer face of a terminal portion of the distributor plunger 3 to a pump work chamber 6 which is adjoined by the distributor plunger 3. During the pressure stroke or rightward stroke of the distributor plunger 3, fuel under pressure is delivered from the pump work chamber 6 through a distributor channel 7 to one of outlet channels 8 (only one shown). Therefrom fuel is delivered through the associated one of delivery valves 9 to one of injection nozzles (not shown). In this manner, fuel is sequentially injected to the cylinders of the engine.

In the distributor plunger 3 there is provided a transversal channel or relief channel 10 which cooperates with a control sleeve 11. The control sleeve 11 is axially displaceable on the distributor plunger 3 to seal and unseal the mouths of the relief channel 10 in the outer surface of the distributor plunger 3. When the control sleeve 11 unseals or uncovers the mouths of the relief channel 10, the pump chamber 6 is drained into the inner chamber 1*a* of the pump housing 1 to terminate the fuel delivery to the injection nozzles. Hence it is possible to alter the terminal moment of fuel delivery during each pressure stroke of the distributor plunger 3 and therefore the quantity of fuel delivered to the engine by changing the position of the control sleeve 11. For example, leftward displacement of the control sleeve 11 in the drawing results in reduced injected fuel quantity.

The axial position of the control sleeve 11 is controlled by a governor mechanism which comprises a governor shaft 12 which is fixedly attached to the pump housing 1. On the governor shaft 12 there is rotatably mounted a centrifugal weight holder 13. The holder 13 is powered by the aforementioned power transmitting means (not shown) for the distributor plunger 3 by way of a multiplying gear (also not shown). In the centrigugal weight holder 13 there are supported centrifugal weights 14 which are rotatable about the governor shaft 12 while swinging outwardly due to the centrifugal force and displacing by means of fingers 14*a* thereof a governor sleeve 15, which is axially displaceable on the governor shaft 12, in the rightward direction in the drawing. The governor sleeve 15 abuttingly engages at the lefthand end thereof with the upper arm portion of a starting lever 16 which is swingably supported on a pivot 17. The lower arm portion of the starting lever 16 has a spherical terminus 16*a* which extends into a depression of the control sleeve 11 for causing axial displacement of the control sleeve. On the pivot 17 there is also swingably supported a tensioning lever 18. Between the tensioning lever 18 and the starting lever 16 there is interposed a starting spring or an excess fuel spring 19 in the form of a leaf spring. The tensioning lever 18 is operatively connected through an idle spring 20, a governor main spring 21 and a control lever 22 to an accelerator pedal (not shown). Reference numeral 23 designates a stopper which limits the extent of counterclockwise swing of the tension lever 18.

The operation of the governor mechanism thus described will be explained hereinbelow with additional reference to FIG. 2.

When the engine is stopped and therefore in the absence of motion of the centrifugal weights 14, the centrifugal weights 14 are put into the completely closed condition due to the bias of the starting spring 19 transmitted thereto by way of the starting lever 16 and at the same time the control sleeve 11 is moved into the starting position or the most rightward position thereof (represented by the horizontal line A in the graph of FIG. 2) in the drawing (FIG. 1) whereby an excess fuel quantity required by the engine during starting is obtained.

When the engine starts and in the absence of depression on the accelerator pedal, the control lever 22 is put into the idle position and therefore the tension of the governor spring 21 reduces approximately to zero. The centrifugal weights 14 are thus permitted to swing outwardly even in the relatively low rotational conditions thereof and displaces the governor sleeve 15 rightwardly turning the starting lever 16 together with the tension lever 18 and compressing both the starting spring 19 and the idle spring 20, resulting in that the control sleeve 11 moves leftwardly into the idle position which is determined by the balance of the centrifugal force and the biasing forces of the starting spring 19 and the idle spring 20. In this manner, the quantity of fuel necessary for smooth idle of the engine is obtained as represented by the point B in the graph of FIG. 2.

When the accelerator pedal is then depressed to move the control lever 22 to some extent, the tension of the governor main spring 21 becomes larger and consequently both the starting spring 19 and the idle spring 20 are compressed to be of shorter length permitting the tension lever 18 to swing counterclockwise until it abuttingly engages with the stopper 23. Actuated by such swing of the tension lever 18, the starting lever 16 displaces the control sleeve 11 to the full load position as is represented by the point C in the graph of FIG. 2. The control sleeve 11 remains thereat permitting the engine speed to increase up to the value as is represented by the point D in the graph of FIG. 2 where the centrifugal weights 14 start to displace the governor sleeve 15 prevailing the counter force thereto. After that, the control sleeve 11 is displaced in the fuel-increasing direction, i.e., leftwardly into the position as represented by the point E in the graph of FIG. 2 which is determined by the balance of the centrifugal force of the centrifugal weights 14 and the biasing forces of the springs 19, 20 and 21. The engine speed is thus controlled so as to correspond to the amount of depression on the accelerator pedal.

The foregoing pivot 17 is carried on a full load fuel quantity adjusting lever 24 which is pivotally supported on a stationary pivot 25. The adjusting lever 24 is normally held stationary but is caused to swing about the stationary pivot 25 by rotating a screw 26 to change the setting of the full load fuel quantity. Designated by the reference numeral 27 is a fuel-cut solenoid valve for stopping the engine.

The governor sleeve 15 has an inner space 30 which is adjoined by an end of the governor shaft 12 and which varies in volume in response to axial displacement of the governor sleeve on the governor shaft. In order to draw fuel from the inner chamber 1*a* of the pump housing 1 into the inner space 30 and on the other hand to discharge fuel from the inner space 30 into the inner chamber 1*a* in response to the variation in volume of the inner space 30, there is provided in the governor sleeve 15 an opening P which provides communication between the inner space 30 and the inner chamber 1*a*. The flow passage sectional area of the opening P has heretofore been designed to be relatively large for the reason of good responsivity.

Though the prior art distributor-type fuel injection pump with such governor mechanism produces good results upon engine deceleration due to the good responsivity, it tends to produce undesirable results upon rapid engine acceleration due to the good responsivity. That is, upon rapid engine acceleration, the control lever 22 actuates, by way of the governor main spring 21, the starting lever 16 together with the tension lever 18 to rapidly swing in the counterclockwise direction displacing the governor sleeve 15 leftwardly in the drawing. In response to such displacement of the governor 15, the control sleeve 11 is rapidly displaced rightwardly or in the fuel-increasing direction. As a result, the quantity of fuel delivered to the engine increases rapidly, resulting in an acceleration jerk which is unacceptable for good drivability and smoky exhaust emission from the engine. This is because at the initial stage of the rapid engine acceleration, the rate of engine air flow can not quickly increase so as to match the increased quantity of fuel delivered to the engine, that is, the increase in rate of engine air flow lags behind the increase in quantity of fuel delivered to the engine.

OBJECTS OF THE INVENTION

It is accordingly an object of the present invention to provide an distributor-type fuel injection pump with an improved governor mechanism which is free from the foregoing drawbacks inherent in the prior art comparable fuel injection pump.

It is another object of the present invention to provide a distributor-type fuel injection pump of the above described character which is constructed to prevent an acceleration jerk upon rapid engine acceleration.

It is a further object of the present invention to provide a distributor-type fuel injection pump of the above described character which is constructed to prevent smoky exhaust emission from a Diesel engine upon rapid engine acceleration.

It is a yet further object of the present invention to provide a distributor-type fuel injection pump of the above described character which is constructed to prevent noxious exhaust emissions from the engine upon rapid engine acceleration.

BRIEF DESCRIPTION OF THE DRAWINGS

The features and advantages of the present invention wil become more apparent from the following description taken in conjunction with the accompanying drawings, in which like reference numerals designate like parts throughout the several views and in which.

DESCRIPTION OF THE PREFERRED EMBODIMENT

Figure 1:
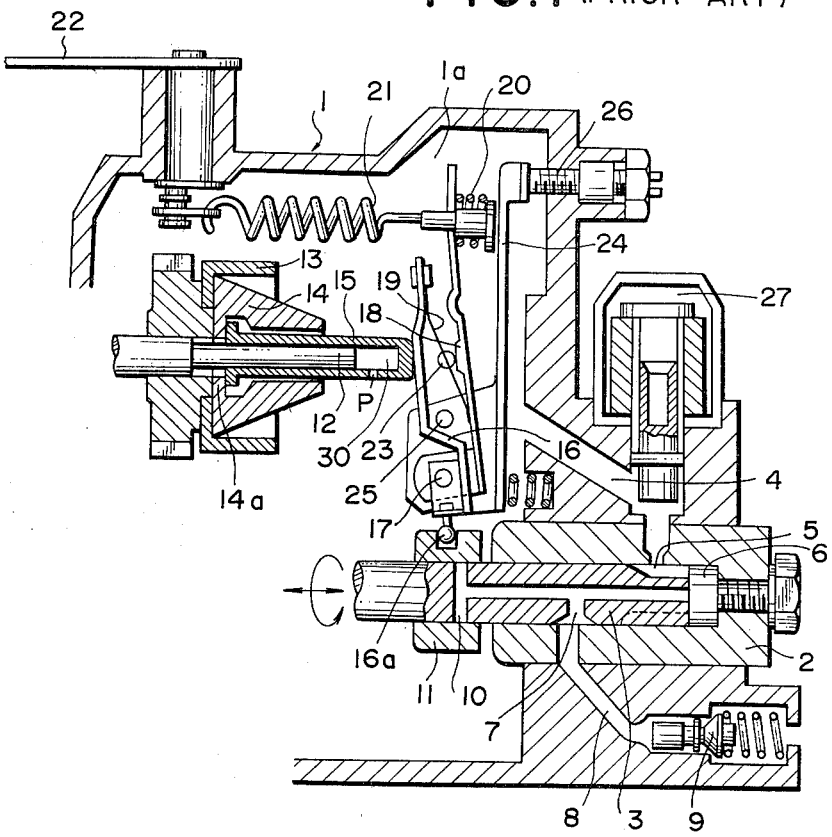
FIG. 1 (PRIOR ART)
FIG. 1 is a sectional view partly broken away showing a prior art distributor-type fuel injection pump with which the present invention is concerned.
Figure 2:
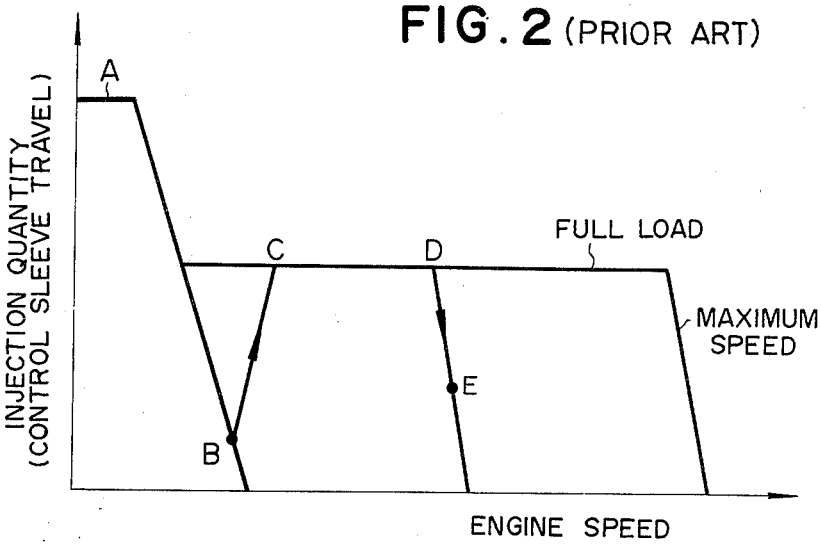
FIG. 2 (PRIOR ART)
FIG. 2 is a graph showing the operation characteristics of the governor mechanism of the fuel injection pump of FIG. 1.
Figure 3:
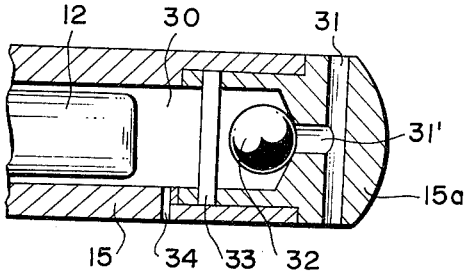
FIG. 3 is a fragmentary sectional view showing a part of a governor mechanism of a distributor-type fuel injection pump embodying the present invention.

FIG. 3 shows a part of a governor mechanism of a distributor-type fuel injection pump embodying the present invention and in which omitted parts are substantially similar to the prior art fuel injection pump of FIG. 1.

In the figure, designated by the reference numeral 12 is a governor shart, by 15 a governor sleeve and by 30 an inner space of the governor shaft defined by an end of the governor shaft.

The end portion of the governor sleeve 15 is formed into a separate cap 15*a* which is press fit assembled to the body of the governor sleeve 15. The cap 15*a* is provided with a transversal channel 31 communicated at the opposite ends with the inner chamber 1*a* of the pump housing 1 and an axial channel 31' which extends from the transversal channel 31 to the inner space 30. Within the inner space 30 there is disposed a ball 32 which serves a check valve. The cap 15*a* is fitted with a transversal pin 33 which limits the extent of movement of the ball 32 in the direction away from the mouth of the axial channel 31' in the spherical inner face of the cap 15*a*. The ball 32 is preferably formed of such a material as to be light in weight and durable such as, for example, Teflon (trade name). In the body of the governor sleeve 15 there is formed an opening 34 which provides communication between the inner space 30 and the inner chamber 1*a* of the pump housing 1. The opening 34 is so constructed as to have a smaller flow passage cross sectional area than the transversal and axial channels 31, 31'. Thus the inner space 30 communicates with the inner chamber 1*a* through two separate fluid flow passageway, one of which has a relatively large flow passage cross sectional area and is comprised of the transversal and axial channels 31, 31' and the other of which has a relatively small flow passage cross sectional area and is comprised of the opening 34. The ball 32 is operatively connected to the passageway of a relatively large flow passage cross sectional area and serves as a check valve.

The operation of the distributor-type fuel injection pump with an improved governor mechanism thus described according to the present invention is now described hereinbelow with additional reference to FIG. 1.

Upon engine acceleration, the governor sleeve 15 is actuated by the tension lever 18 and the starting lever 16 to be displaced leftwardly in the drawing. In this instance, as the governor sleeve 15 is increasingly displaced in the leftward direction, the quantity of fuel contained in the inner space 30 increasingly flows out therefrom through the channels 31, 31' and the opening 34 into the inner chamber 1*a* of the pump housing 1 to permit the contraction of the inner space 30. Such outflow of fuel causes the ball 32 to move leftwardly into the position where the ball 32 closes the axial channel 31' to inhibit the outflow of fuel therethrough. As a result, the governor sleeve 15 is allowed to be axially displaced in accordance with the quantity of fuel drained off from the inner space 30 only through the opening 34 of a relatively small flow passage cross sectional area. The governor sleeve 15 is therefore slow in axial displacement in the leftward direction, i.e., the governor sleeve 15 is desplaced relatively insensitively.

Upon engine deceleration, the centrifugal weights 14 are swung outwardly causing the governor sleeve 15 to be displaced rightwardly in the drawing. In this instance, as the governor sleeve 15 is increasingly displaced rightwardly, the quantity of fuel flows from the inner chamber 1*a* of the housing into the inner space 30 to permit the expansion of the inner space. Such inflow of fuel moves the ball 32 away from the mouth of the axial channel 31' in the inner spherical face of the cap 15*a* toward the transversal pin 33. As a result, the axial channel 31' opens into the inner space 30 permitting fuel to flow into the inner space 30 through the aforementioned two separate fluid flow passageways. The distributor sleeve 15 is thus displaced quite sensitively upon engine deceleration.

By the foregoing, there have been provided a distributor-type fuel injection pump with an improved governor mechanism which relatively quickly responds to the demand for engine deceleration whereas relatively slowly to the demand for engine acceleration, preventing an acceleration jerk and smoky exhaust.

Figure 4:
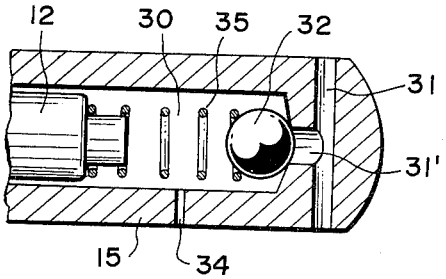
FIG. 4 is a view similar to FIG. 3 and showing another embodiment according to the present invention.

FIG. 4 shows another embodiment according to this invention. In this embodiment, there is employed a spring 35 interposed between the ball 32 and an end of the governor shaft 12. The spring 35 biases the ball 32 against the mouth of the axial channel 31' in the spherical inner face of the governor sleeve 15 to ensure the function of the ball 35 as a check valve. In this instance, the spring 35 is designed to be of sufficiently small spring rate and of proper length so as to be capable of biasing the ball 32 when the governor sleeve 15 moves into the most rightward position thereof.

Figure 5:
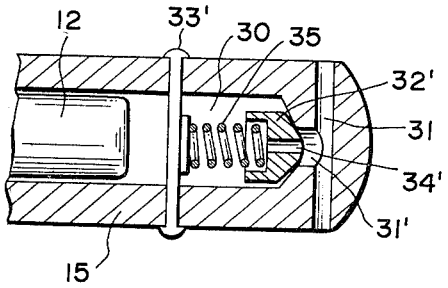
FIG. 5 is a view similar to FIG. 3 and showing a further embodiment according to the present invention.

FIG. 5 shows a further embodiment according to this invention.

In this embodiment, there is employed a valve element 32' which is formed with an opening 34'. To the governor sleeve 15 there is fixedly attached a tranversal pin with a spring retainer 33' and between the latter and the valve element 32' there is interposed a spring 35 to bias the valve element against the mouth of the axial channel 31'. Alternatedly, the spring 15 can be dispensed with by arranging the pin 33' closer to the mouth of the axial channel 31' as in the case of FIG. 3. Alternately, the transversal pin with a spring retainer 33' can be dispensed with by interposing the spring 35 between the valve element 31' and one end of the governor shaft 12 as in the case of FIG. 4. The valve element 32' can easily be made of a plastic by moulding, thus effecting an advantage in being easy to manufacture the governor sleeve 15 as well as the valve element 32'.

By the foregoing, there has been provided an improved governor mechanism of a distributor-type fuel injection pump calculated to fulfil the objects hereinabove set forth and while preferred embodiments have been illustrated and described in detail hereinabove, various additions, substitutions, modifications and omissions may be made thereto without departing from the spirit of the invention as encompassed by the appended claims.

What is claimed is:

1. In a distributor-type fuel injection pump for an internal combustion engine, including:

a pump housing having an inner chamber charged with fuel;

means forming a pump work chamber in communication with said inner chamber;

a distributor plunger adjoining said pump work chamber and delivering a quantity of fuel to said engine for injection during each pressure stroke, said distributor plunger having a relief channel in communication with said pump work chamber;

a control sleeve mounted on said distributor plunger for controlling said relief channel; and a governor mechanism controlling the axial position of said control sleeve to vary said quantity of injected fuel by changing the terminal moment of fuel delivery during each pressure stroke of said distributor plunger, said governor mechanism having a stantionary governor shaft, a governor sleeve axially displaceable on said governor shaft and having an inner space adjoined by said governor shaft and in communication with said inner chamber, centrifugal weights rotatable about said governor shaft while swinging outwardly displacing said governor sleeve in the direction to produce expansion of said inner space, and coupling means providing operative connection between said control sleeve and said governor sleeve;

in which said control sleeve is displaced in the direction to increase said quantity of injected fuel in response to displacement of said governor sleeve in the direction to produce contraction of said inner space;

the improvement comprising valve and channel means providing restricted communication between said inner space and said inner chamber upon displacement of said governor sleeve in the direction to produce contraction of said inner space and substantially unrestricted communication between said inner space and said inner chamber upon displacement of said governor sleeve in the opposite direction to produce expansion of said inner space.

2. The improvement in a distributor-type fuel injection pump as claimed in claim 1, in which said valve and channel means comprises:

two separate fluid flow passageways formed in said governor sleeve and each providing communication between said inner space and said inner chamber, one of said passageways being of a relatively large flow passage cross sectional area and the other being of a relatively small flow passage cross sectional area; and a check valve operatively connected to said one fluid flow passageway of a relatively large flow passage cross sectional area.

3. The improvement in a distributor-type fuel injection pump as claimed in claim 2, in which said check valve includes a ball received in said inner space.

4. The improvement in a distributor-type fuel injection pump as claimed in claim 3, in which said one passageway of a relatively large flow passage sectional area has a mouth opening into said inner space, and in which said check valve further includes a transversal pin which limits the extent of movement of said ball away from said mouth.

5. The improvement in a distributor fuel injection pump as claimed in claim 3, in which said check valve further includes a spring interposed between said ball and one end of said governor shaft.

6. The improvement in a distributor-type fuel injection pump as claimed in claim 1, in which said valve and channel means comprises:

a fluid flow passageway of a relatively large flow passage cross sectional area, formed in said governor sleeve and having a mouth opening to said inner space;

a sleeve element disposed in said inner space and having an opening passing therethrough and of a relatively small flow passage cross sectional area, said valve element being movable toward and away from said mouth so as to be put into a first condition in which it opens said mouth and a second condition in which it partially closes said mouth by permitting said opening to establish communication between said passageway and said inner space.

7. The improvement in a distributor-type fuel injection pump as claimed in claim 6, in which said valve and channel means further comprises:

a transversal pin with a spring retainer fitted to said governor sleeve; and a spring interposed between said spring retainer and said valve element.

* * * * *